United States Patent [19]

Schulze-Heil

[11] 4,249,894

[45] Feb. 10, 1981

[54] BLAST FURNACE FOR HEATING GRANULAR MATERIAL

[75] Inventor: Bernhard Schulze-Heil, Wülfrath, Fed. Rep. of Germany

[73] Assignee: Rheinische Kalksteinwerke GmbH, Wülfrath, Fed. Rep. of Germany

[21] Appl. No.: 907,535

[22] Filed: May 19, 1978

[30] Foreign Application Priority Data

May 20, 1977 [DE] Fed. Rep. of Germany ..... 2722719

[51] Int. Cl.[3] ..... F27D 1/08; C21B 7/08

[52] U.S. Cl. ..... 432/95; 266/197; 266/282; 266/283

[58] Field of Search ..... 432/95; 266/154, 197, 266/282, 283

[56] References Cited

U.S. PATENT DOCUMENTS

| | | | |
|---|---|---|---|
| 1,152,050 | 8/1915 | Roitzheim | 432/95 |
| 3,822,989 | 7/1974 | Tschinkel | 432/95 |
| 4,009,870 | 3/1977 | Obenchain | 266/197 |

FOREIGN PATENT DOCUMENTS 2317303 11/1973 Fed. Rep. of Germany .

*Primary Examiner*—John J. Camby

*Attorney, Agent, or Firm*—Allison C. Collard; Thomas M. Galgano

[57] ABSTRACT

An improved blast furnace for heating granular materials is provided of the "CCR" type which includes two similar stacks disposed side by side, one of which heats the goods by direct current while the discharging gases escape from the other parallel unheated stack in a countercurrent manner. Both of the stacks are provided with an annular channel between the heating and cooling zones thereof which is formed by hollow generally cylindrical members which are connected with each other by cross-intersecting channels. These cylinders are suspended in the enlarged bosh-like lower ends of the stacks by supports which do not extend below the cylinder members, so as to minimize damage to the supports.

5 Claims, 13 Drawing Figures

BLAST FURNACE FOR HEATING GRANULAR MATERIAL

Figure 1A:
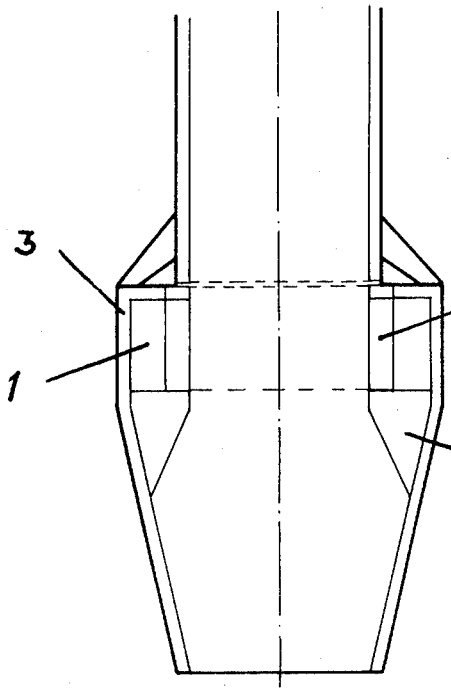
PRIOR ART FIG. 1A

The present invention relates to a blast furnace for heating granular material. More particularly, it relates to a shaft kiln which essentially includes two similar stacks or pits, one of which is heated by means of a direct current while the discharge gases escape from the other parallel unheated stack in a counter-current manner, and both stacks of which are provided with an annular channel between the heating zone and the cooling zone thereof, formed by hollow, generally cylindrical members which are connected with each other by cross-intersecting channels.

This type of kiln is generally known as a CCR kiln (direct current-countercurrent-regenerative kiln) and is particularly used in the lime making industry. A modern, improved embodiment of this type of kiln is described in German Laid Open Patent No. 2,317,303. The annular channel between the heating zone and the cooling zone is formed on the bosh-like enlarged furnace shell or jacket which has a hollow inverted frustoconical end portion by generally cylindrical members which are mounted on supports of the enlarged outer furnace shell. As a result, the heated material to be heated flows to the lower part of the hollow cylinder, so that a part of the support is above the heated granular material heated and a part is below the granular material.

It has been shown that the supports are not only expensive to make but need frequent repairs. It is assumed that the frequent repairs are required because of the temperature difference between the material to be heated and the discharge gases. A typical damage to the brick lining of the shaft kiln is that the supports tear at the point where the heated material forms a slope, whereby a thermal tension is created. Thereby, the worn-out supports collapse the curvature of the supports. In this case, the hollow, cylindrical-like support lining of the kiln weakens and is pushed downwardly together with the heated material to be heated. Naturally, the damage done is expensive in addition to the production loss.

It is, therefore, an object of the invention to improve the CCR kilns in such a way that the damages caused by the thermal tension is reduced, while, at the same time, reducing the costs for construction and repair.

This object of the invention is obtained in that the hollow cylinder-like members are supported in the enlarged kiln shell and/or are so suspended that none of the suspensions or supports extend below the sloped surface of the stack which receives the heated material.

In accordance with the invention, a suspended, heat-resistant annular cylinder made of steel may be installed instead of the expensive support and curved lining. This annular inner cylinder may be mounted by additional supports on the outer face of the annular channel. However, additional supports should not be used and corresponding constructive measurements are taken when the hollow cylinder and its suspension are installed in order to satisfy the static requirements. This is advantageous in that the amount of dust deposits is reduced and that the annular channel is not obstructed by supports or other installed members.

In accordance with a further embodiment of the invention, a cooling system is installed in the hollow cylindrical member. This cooling system permits the use of less heat-resistant but cheaper steel.

It is particularly advantageous to enlarge the lower portion of the hollow cylinder-like member so that the material to be heated, and which presses against the side walls, does not damage the lining of the lower part of the cylinder segment.

Other objects and features of the present invention will become apparent from the following detailed description when taken in connection with the accompanying drawings which discloses several embodiments of the invention. It is to be understood that the drawings are designed for the purpose of illustration only, and are not intended as a definition of the limits and scope of the invention disclosed.

Figure 1B:
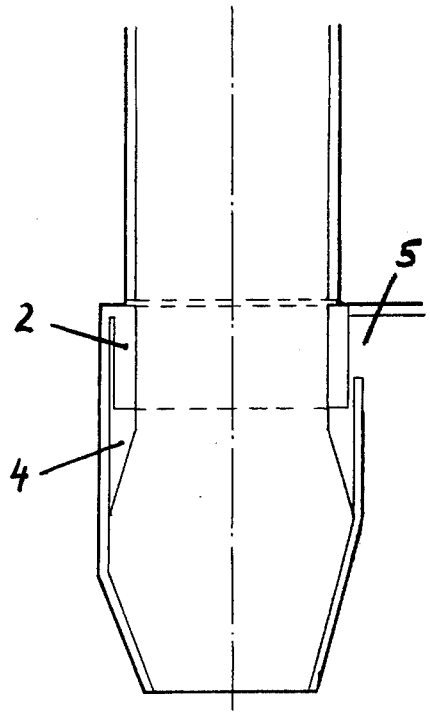
PRIOR ART FIG. 1B
Figure 1C:
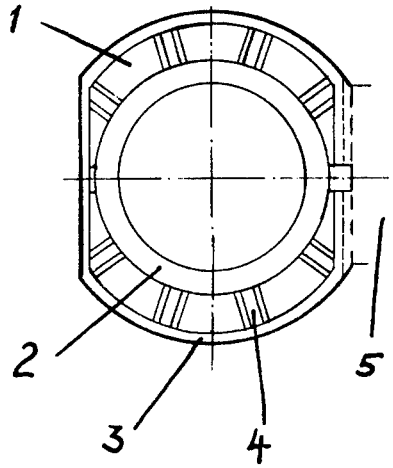
FIG. 1C PRIOR ART

In the drawings, wherein similar reference numerals denote similar elements throughout the several views:

FIG. 1*a* is a fragmentarily-illustrated longitudinal sectional view of a conventional CCR kiln;

FIG. 1*b* is another fragmentarily-illustrated longitudinal sectional view, similar to that of FIG. 1*a*, but offset 90° C. therefrom;

FIG. 1*c* is a cross-sectional view taken along line 1*c*—1*c* of FIG. 1*b;*

Figure 2A:
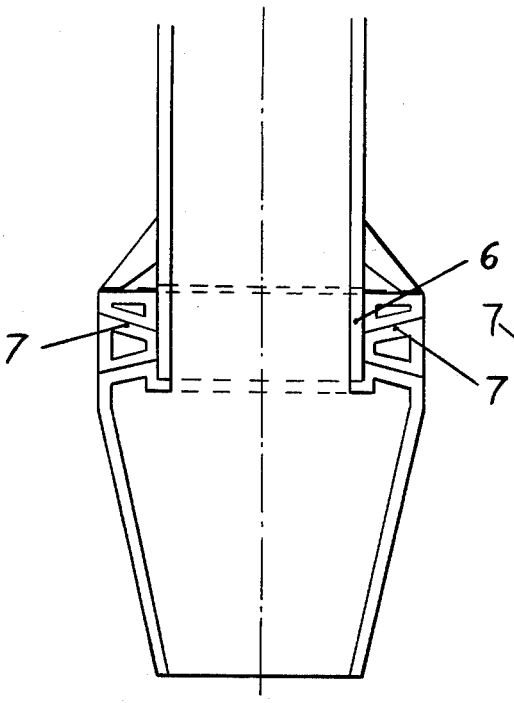
Figure 2B:
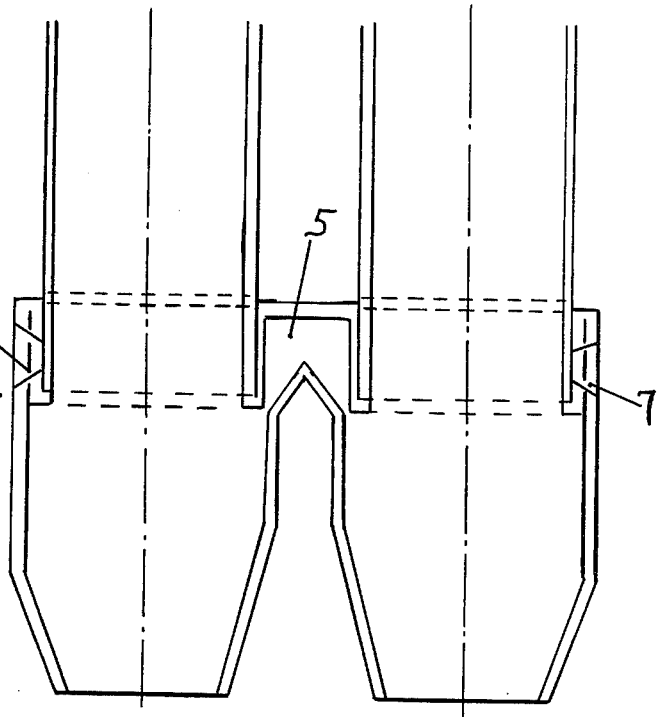
Figure 2C:
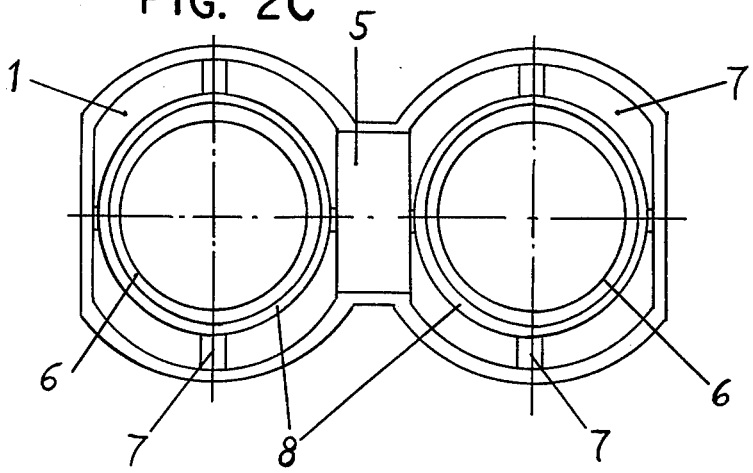

FIG. 2*a* is a fragmentarily-illustrated, longitudinal sectional view of a CCR kiln embodying the present invention;

FIG. 2*b* is another fragmentarily-illustrated longitudinal sectional view, similar to that of FIG. 2*a*, but offset 90° therefrom;

FIG. 2*c* is a cross-sectional view taken along line 2*c*—2*c* of FIG. 2*b;*

Figure 3A:
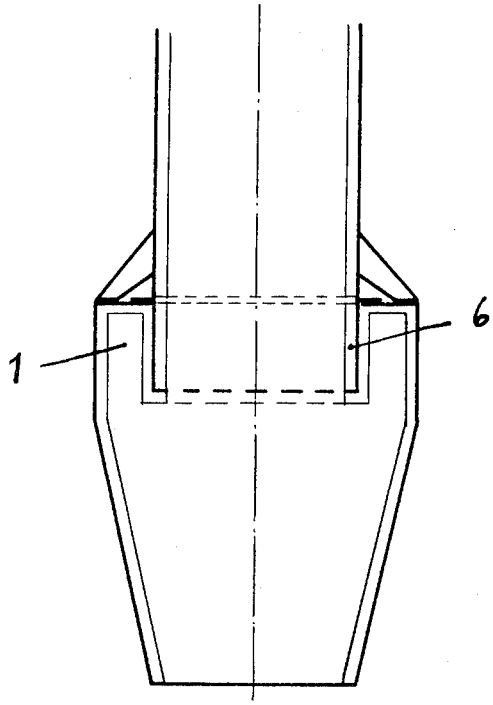
Figure 3B:
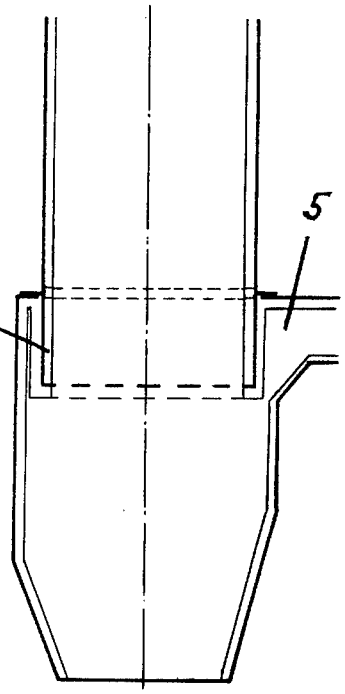
Figure 3D:
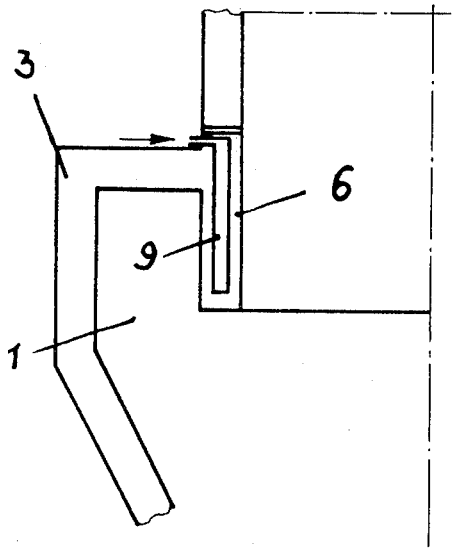
Figure 3C:
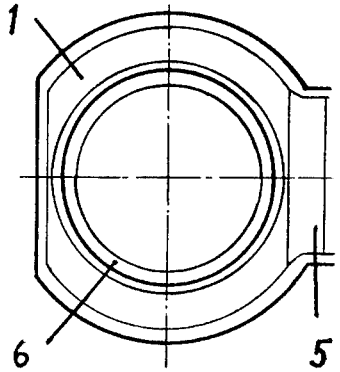

FIG. 3*a* is a fragmentarily-illustrated longitudinal sectional view of a CCR kiln showing another embodiment of the present invention;

FIG. 3*b* is another fragmentarily-illustrated longitudinal sectional view, similar to that of FIG. 3*a*, but offset 90° therefrom;

FIG. 3*c* is a cross-sectional view taken along line 3*c*—3*c* of FIG. 3*b;*

Figure 4A:
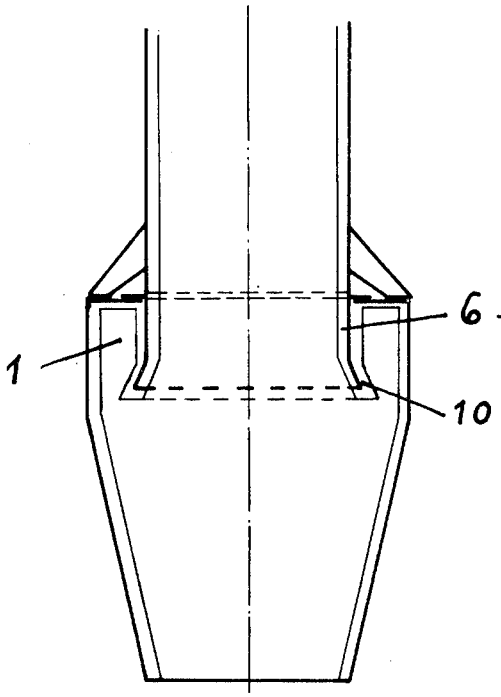
Figure 4B:
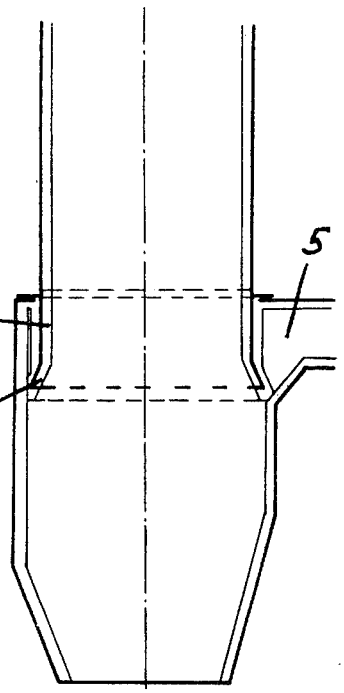
Figure 4C:
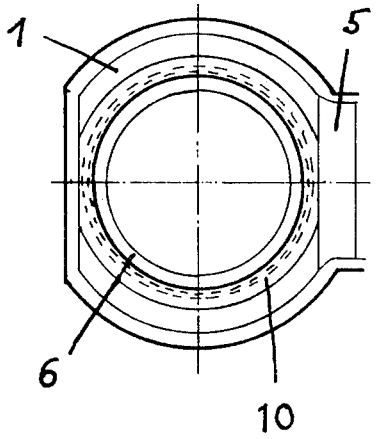

FIG. 3*d* is an enlarged, fragmentarily-illustrated sectional view of a portion of the kiln shown in FIG. 3*a*, further showing a portion of the cooling system thereof;

FIG. 4*a* is a fragmentarily-illustrated, longitudinal sectional view of a CCR kiln showing still another embodiment of the present invention;

FIG. 4*b* is another fragmentarily-illustrated longitudinal sectional view, similar to that of FIG. 4*a*, but offset 90° therefrom;

FIG. 4*c* is a cross-sectional view taken along line 4*c*—4*c* of FIG. 4*b*.

As shown in FIGS. 1*a*, 1*b*, and 1*c*, a CCR open pit or stack is provided having an annular channel 1 which is formed between a hollow cylindrical member 2 and an enlarged bosh-like furnace or kiln shell or jacket 3 having a generally inverted frustoconical configuration. Inner cylinder 2 is supported by a curvature (not shown) and a support 4. The reference numeral 5 refers to the overflow channel for the adjacent stack.

FIGS. 2*a*, 2*b*, and 2*c* illustrate an inventive embodiment of the CCR kiln in the range of the overflow channel in comparison with FIGS. 1*a*, 1*b*, and 1*c*. The hollow cylindrical member 6 is suspended on the upper stack portion and is additionally mounted on supports 7 of the enlarged outer furnace shell 3. Cylindrical member 6 consists of a hollow steel cylinder 8 around which a fire proof wall lining is mounted, as shown in the drawing. The heated material slopes beneath cylinder member 6, so that portions of the suspension or the mounting do not extend into the conical sloping portion of the stack.

FIG. 3*a*, 3*b*, 3*c* shows corresponding sections of a kiln construction in comparison with the invention wherein the cylindrical member is suspended on lateral supports in accordance with FIGS. 2*a*, 2*b*, and 2*c*.

FIG. 3*d* shows that the inner steel construction of the hollow cylindrical member is part of a cooling system 9. The supply for the cooling medium is shown by the arrow.

FIGS. 4*a*, 4*b*, and 4*c* shows a further advantageous embodiment in comparison with FIGS. 1*a*, 1*b*, and 1*c*. The hollow cylinder 6 is only suspended in this case and the lower end portion thereof is conically expanded.

While only several embodiments of the present invention has been shown and described, it will be obvious to those persons of ordinary skill in the art that many changes and modifications may be made thereunto without departing from the spirit and scope of the invention.

What is claimed is:

1. An improved lime-making vertical shaft-kiln for heating granular goods of the type including at least two similar interconnected furnace stacks, one of which heats the granular material by direct current while the discharge gases of the stack escape from the other unheated stack in a countercurrent movement, and wherein each of the stacks has a heating zone and a cooling zone and a hollow cylindrical member defining an annular channel disposed between the heating and cooling zones, the channels of each stack being connected to each other by cross-over canal means, the improvement comprising:

said stacks each having an enlarged, bosh-like shell wall joined to the lower end thereof having an upper cylindrical portion disposed laterally adjacent to and spaced from said hollow cylindrical member and a lower downwardly tapering frustoconical portion and means for suspending said shell walls from the lower end of the stack associated therewith which comprises a first set of support members, each of which has an upper end coupled to the lower end of said stack above said hollow cylindrical member and an opposite lower end connected to the upper end of said upper cylindrical portion of said shell wall as a result of which said support means is disposed above the frustoconical portion of the shell wall and is not exposed to the sloping heated material normally located in said lower frustoconical portions.

2. The shaft-kiln according to claim 1, additionally including means for cooling said cylindrical members.

3. The shaft-kiln according to claim 2, wherein said hollow cylindrical member comprises a hollow steel cylinder having a fire-proof wall lining.

4. The shaft-kiln according to claim 1, wherein said hollow cylindrical members each have a conically enlarged lower end portion.

5. The shaft-kiln according to claim 1, additionally including a generally horizontally-disposed set of lateral support members, each of which has a first end coupled to said hollow cylindrical member and a second opposite end coupled to said upper cylindrical portion of said shell wall.

* * * * *